US008902270B2

(12) United States Patent
Takagi

(10) Patent No.: US 8,902,270 B2
(45) Date of Patent: Dec. 2, 2014

(54) IMAGE FORMING APPARATUS

(71) Applicant: Konica Minolta, Inc., Chiyoda-ku (JP)

(72) Inventor: Mutsumi Takagi, Hachioji (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/153,572

(22) Filed: Jan. 13, 2014

(65) Prior Publication Data

US 2014/0210926 A1 Jul. 31, 2014

(30) Foreign Application Priority Data

Jan. 31, 2013 (JP) ..... 2013-016292

(51) Int. Cl.

| | |
|---|---|
| ***B41J 27/00*** | (2006.01) |
| ***B41J 2/455*** | (2006.01) |
| ***B41J 15/14*** | (2006.01) |
| ***G03G 15/041*** | (2006.01) |

(52) U.S. Cl.

CPC ..... *G03G 15/0415* (2013.01)
USPC ..... 347/261; 347/259; 347/260; 347/233; 347/243

(58) Field of Classification Search

USPC ..... 347/233, 243, 259–261
See application file for complete search history.

(56) References Cited

U.S. PATENT DOCUMENTS

2007/0268357 A1* 11/2007 Nagata et al. ..... 347/243
2011/0063680 A1* 3/2011 Ohyama ..... 358/1.16

FOREIGN PATENT DOCUMENTS

JP 2007-334303 A 12/2007
JP 2011-100035 A 5/2011

* cited by examiner

*Primary Examiner* — Sarah Al Hashimi
(74) *Attorney, Agent, or Firm* — Buchanan Ingersoll & Rooney PC

(57) ABSTRACT

An image forming apparatus includes an image forming unit which transfers an image obtained through exposure and development to paper, and a control unit which changes a rotation speed of a polygon mirror at an intermediate area on a carrier to change a reduction/magnification ratio of an image. The control unit changes the rotation speed in a stepwise manner in such a way as to allow a stable rotation of the polygon mirror in each step, and controls the image forming unit to form a corrected patch image in parallel with the stepwise change of the rotation speed. The corrected patch image is obtained through correction in accordance with the stepwise change of the rotation speed to be the same as the patch image formed when the rotation speed is not changed.

7 Claims, 8 Drawing Sheets

| PAPER TRAY | PAPER | | | AMOUNT OF CHANGE OF REDUCTION/ MAGNIFICATION | PATCH IMAGE |
|---|---|---|---|---|---|
| | TYPE | BASIS WEIGHT ($g/m^2$) | SIZE | | |
| 1 | HIGH-QUALITY PAPER | 52.3 | A4 | FRONT SIDE → BACK SIDE : - 0.03 | g11 |
| | | | | BACK SIDE → FRONT SIDE : +0.03 | g12 |
| 2 | COATED PAPER | 73.3 | A4 | FRONT SIDE → BACK SIDE : - 0.06 | g21 |
| | | | | BACK SIDE → FRONT SIDE : +0.06 | g22 |
| ... | ... | ... | ... | ... | ... |

FIG. 9

| PAPER TRAY | PAPER | | | AMOUNT OF CHANGE OF REDUCTION/ MAGNIFICATION | PATCH IMAGE |
|---|---|---|---|---|---|
| | TYPE | BASIS WEIGHT ($g/m^2$) | SIZE | | |
| 1 | HIGH-QUALITY PAPER | 52.3 | A4 | FRONT SIDE → BACK SIDE : - 0.03 | g11 |
| | | | | BACK SIDE → FRONT SIDE : +0.03 | g12 |
| 2 | COATED PAPER | 73.3 | A4 | FRONT SIDE → BACK SIDE : - 0.06 | g21 |
| | | | | BACK SIDE → FRONT SIDE : +0.06 | g22 |
| ... | ... | ... | ... | ... | ... |

IMAGE FORMING APPARATUS

BACKGROUND OF THE INVENTION

1. Field of the Invention

The present invention relates to an image forming apparatus.

2. Description of Related Art

An image forming apparatus using an electrophotographic scheme regularly forms a patch image and adjusts image quality in accordance with the measurement of its density to maintain a constant image quality. Basically, time for such image quality adjustment is specially set aside. A patch image is sometimes formed in an intermediate area between front and back sides of paper to obtain a stable image quality during image formation.

In the case in which images are formed on both sides of paper, the paper shrinks due to fixing processing after the image formation on its front side. An image forming apparatus thus changes the reduction/magnification ratio of the image on the back side to correct the difference in position and size between the images on the front and back sides.

Examples of the methods to change the reduction/magnification ratio of an image include changing the rotation speed of a polygon mirror which changes the direction of laser light at the area between the front and back sides of paper.

There is a case in which the rotation speed of a polygon mirror is changed at an intermediate area and in which a patch image is formed in the same intermediate area for adjustment of image quality. A patch image, however, is usually formed after the change of the rotation speed of the polygon mirror because forming a patch image in parallel with the speed change of the polygon mirror causes deformation and variation in density of the patch image (see, for example, Japanese Unexamined Patent Application Publication Nos. 2011-100035 and 2007-334303). Although some patch images can be formed in parallel with the speed change, such patch images are limited to those which allow any positions, shapes, or densities, such as a patch image for toner consumption shown in Japanese Unexamined Patent Application Publication No. 2007-334303.

To achieve speed-up and improve productivity, however, an image forming apparatus is required to have a shorter interval on which continuous image formation is performed, i.e., a shorter intermediate area.

Under such circumstances, the techniques of Japanese Unexamined Patent Application Publication Nos. 2011-100035 and 2007-334303 change the rotation speed of the polygon mirror to a target speed at once and thus can shorten the time required for the speed change. Unfortunately, however, changing the speed at once in such a way causes unstable rotation immediately after the speed change. The image forming apparatus, therefore, has to wait to perform image formation until the rotation stabilizes. The remaining time after the rotation has stabilized is not enough for the formation of a patch image. It is difficult for such an apparatus to form a patch image in an intermediate area in parallel with changing the rotation speed of the polygon mirror at the same intermediate area.

SUMMARY OF THE INVENTION

An object of the present invention is to form a patch image in parallel with changing a rotation speed of a polygon mirror at an intermediate area in such a way that the patch image to be formed is the same as the patch image formed when the rotation speed is not changed.

In order to solve the above-mentioned object, according to an aspect of a preferred embodiment of the present invention, there is provided an image forming apparatus including: an image forming unit which exposes a photoreceptor using a polygon mirror and transfers an image obtained by developing an electrostatic latent image formed on the photoreceptor to paper through a carrier; and a control unit which changes a rotation speed of the polygon mirror at an intermediate area on the carrier to change a reduction/magnification ratio of an image to be formed, wherein when a patch image is formed in the intermediate area, the control unit changes the rotation speed of the polygon mirror in a stepwise manner in such a way that the change of the rotation speed in each step is within a range to allow a stable rotation of the polygon mirror; and controls the image forming unit to form a corrected patch image in parallel with the stepwise change of the rotation speed, the corrected patch image being obtained through correction of an original patch image in accordance with the stepwise change of the rotation speed to be the same as a patch image formed when the rotation speed is not changed.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 9 shows an example of a table in which an optimum patch image is determined for each type and size of paper.

DESCRIPTION OF THE PREFERRED EMBODIMENTS

An image forming apparatus of an embodiment of the present invention is described below with reference to the drawings.

Figure 1:
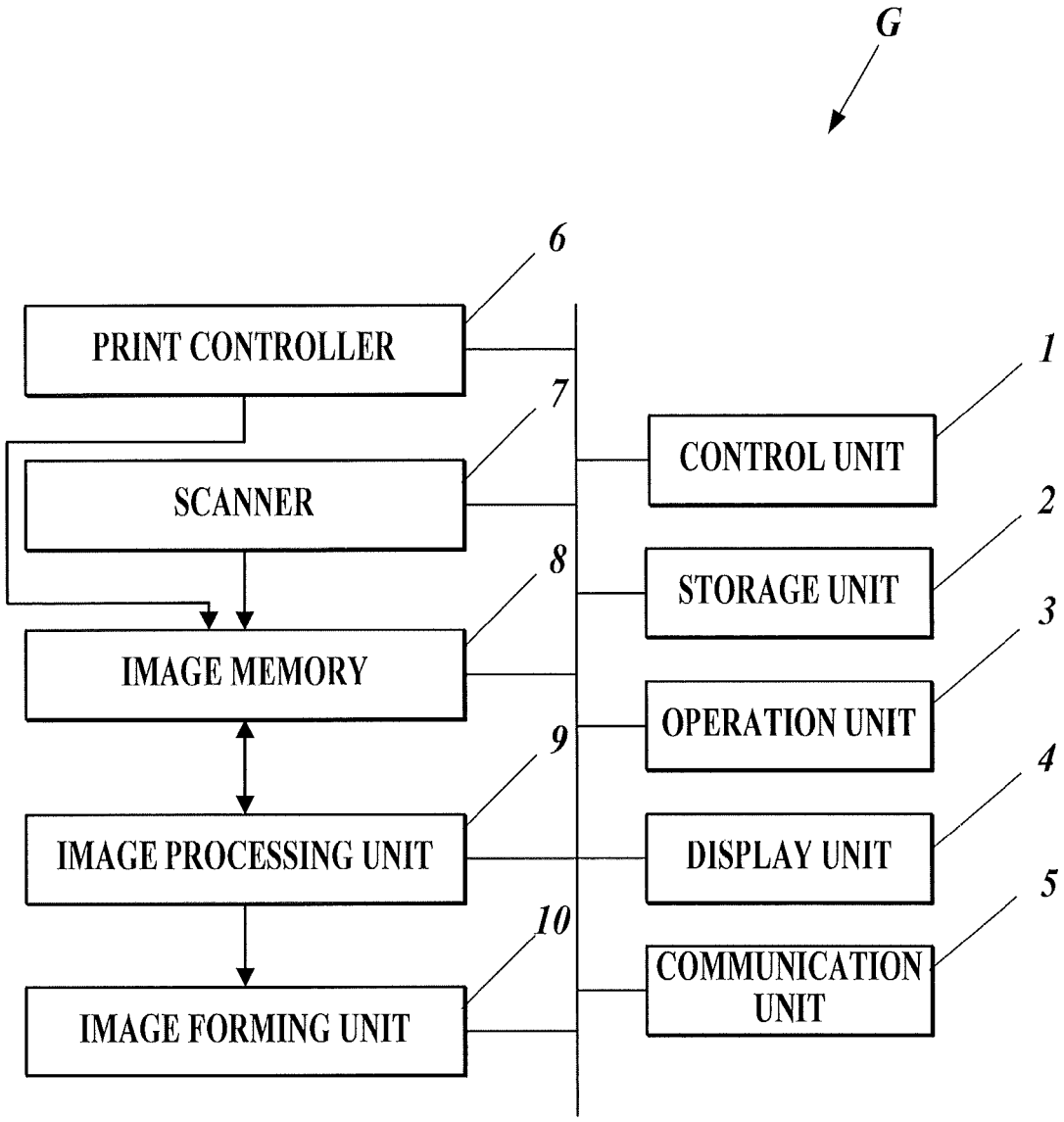
FIG. 1 is a functional block diagram of an image forming apparatus of an embodiment of the present invention.

FIG. 1 illustrates an image forming apparatus G of this embodiment.

As shown in FIG. 1, the image forming apparatus G includes a control unit 1, a storage unit 2, an operation unit 3, a display unit 4, a communication unit 5, a print controller 6, a scanner 7, an image memory 8, an image processing unit 9, and an image forming unit 10.

The control unit 1 includes, for example, a central processing unit (CPU) and a random access memory (RAM). The control unit 1 reads a program contained in the storage unit 2 to control each unit of the image forming apparatus G in accordance with the program.

At the time of image formation on both sides of paper, the control unit 1 changes the rotation speed of the polygon mirror of the image forming unit 10 at an intermediate area between the front and back sides of paper to change the reduction/magnification ratio of an image to be formed. The intermediate area refers to the area on the carrier between the areas each of which corresponds to a side of paper, i.e., the area on the carrier between the area for the front side of paper and the area for the back side of paper.

The control unit 1 reads a patch image for adjusting image quality from the storage unit 2 to control the image forming unit 10 to form the patch image. The control unit 1 adjusts the quality of the image to be formed by the image forming unit 10 in accordance with the measurement of the density value of the patch image.

For example, the control unit 1 controls the image forming unit 10 to form the patch image for which the maximum gradation value is set. The control unit 1 changes the settings for the image forming unit 10, such as the potential for charging of the photoreceptor and the potential for development of the development roller, in accordance with the measurement of density of the patch image to adjust the maximum density of the image.

The control unit 1 also controls the image forming unit 10 to form a plurality of patches for which gradually varied gradation values are set. The control unit 1 updates a look up table (LUT) to be used by the image processing unit 9 for color conversion processing and gradation correction processing in accordance with the measurements of the densities of the patches to adjust the color reproducibility and density of images.

The control unit 1 can also control the image forming unit 10 to form a patch image for toner consumption to allow toner circulation and to obtain stable developability. The patch image for toner consumption is, for example, a belt-like patch image for which the maximum gradation value is set.

When the control unit 1 changes the rotation speed of the polygon mirror of the image forming unit 10 at an intermediate area and also forms a patch image in the same intermediate area, the control unit 1 changes the rotation speed in a stepwise manner in such a way that the change of the rotation speed in each step is within such a range as to allow stable rotations of the polygon mirror. In parallel with the stepwise change of the rotation speed, the control unit 1 controls the image forming unit 10 to form the patch image corrected in accordance with the stepwise change of the rotation speed to be the same as the patch image formed when the rotation speed is not changed.

When the control unit 1 forms a patch image but does not change the rotation speed of the polygon mirror in the intermediate area, the control unit 1 can control the image forming unit 10 to form an uncorrected patch image read from the storage unit 2; while when the control unit 1 changes the rotation speed of the polygon mirror but does not form a patch image in the intermediate area, the control unit 1 can change the rotation speed of the polygon mirror at once to a target speed.

The storage unit 2 contains, for example, programs and files to be read by the control unit 1. A storage medium such as a hard disk and a read only memory (ROM) may be used as the storage unit 2.

The storage unit 2 contains a plurality of types of patch images for adjusting image quality.

The operation unit 3 includes, for example, operation keys and/or a touch panel integrated with the display unit 4. The operation unit 3 receives operations through the keys and/or touch panel and outputs their operation signals to the control unit 1.

The display unit 4, for example, displays an operation screen according to the instructions from the control unit 1.

The communication unit 5 communicates with a server or another image forming apparatus on the network.

The print controller 6 includes a communication section to receive page description language (PDL) data from a computer on the network. The print controller 6 rasterizes the PDL data to generate image data in the form of bitmap. The print controller 6 generates image data of cyan (C), magenta (M), yellow (Y), and black (K). The generated image data is outputted to the image memory 8 to be held therein.

The scanner 7 reads a document and generates image data of red (R), green (G), and blue (B). The generated image data is outputted to the image memory 8 to be held therein.

The image memory 8 is a memory to hold image data. A dynamic random access memory (DRAM), for example, may be used as the image memory 8.

The image processing unit 9 reads the RGB image data from the image memory 8 and converts it into CMYK image data and writes the CMYK image data onto the image memory 8. Specifically, the image processing unit 9 includes an LUT in which CMYK output values are determined for RGB input values, and obtains from the LUT the gradation value of each pixel of the image data after the color conversion.

Further, the image processing unit 9 reads CMYK image data from the image memory 8 and performs gradation correction processing on the CMYK image data. Specifically, the image processing unit 9 includes an LUT in which a gradation correction value is determined for each input value, and obtains from the LUT the correction value of each pixel of the image data.

Eventually, the image processing unit 9 performs halftone processing on the image data and outputs the resultant image data to the image forming unit 10. The halftone processing includes, for example, screen processing and error diffusion processing using Dithering.

The image processing unit 9 corrects a patch image (original patch image) read by the control unit 1 from the storage unit 2 in accordance with a speed change condition for a stepwise change of the rotation speed of the polygon mirror. The image processing unit 9 performs the halftone processing on the corrected patch image and outputs the resultant patch image to the image forming unit 10.

The image forming unit 10 forms an image on paper on the basis of the image data inputted from the image processing unit 9.

Figure 2:
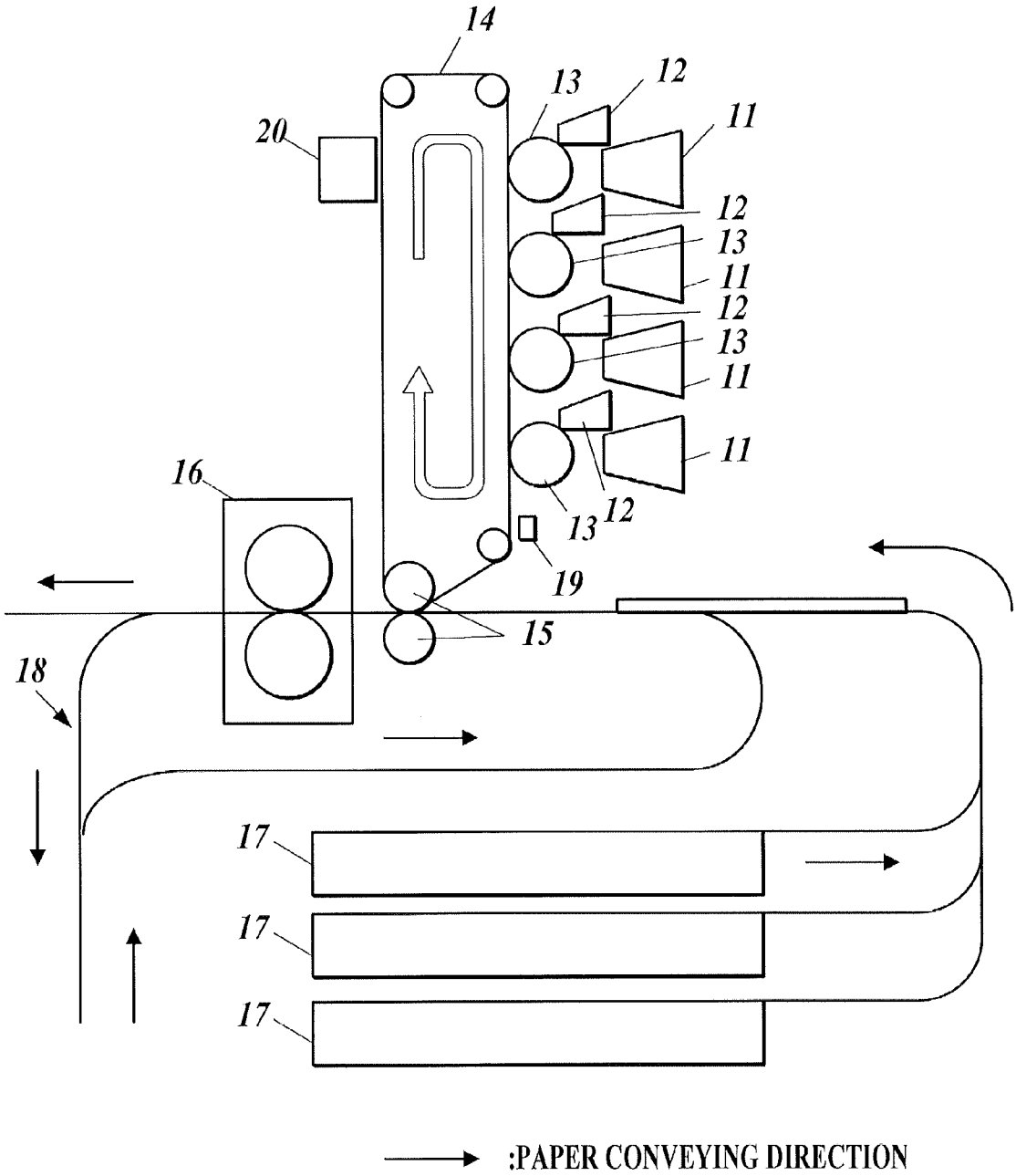
FIG. 2 is a schematic view of an image forming unit of FIG. 1.

FIG. 2 is a schematic view of the image forming unit 10.

As shown in FIG. 2, the image forming unit 10 includes an exposure section 11, a development section 12, and a photoreceptor 13 for each of the four colors of C, M, Y, and K. The image forming unit 10 further includes a carrier 14, secondary transfer rollers 15, a fixing device 16, paper trays 17, a turning-over mechanism 18, a sensor 19, and a cleaning section 20.

Each exposure section 11 exposes the charged and rotating photoreceptor 13 on the basis of image data. Each development section 12 supplies toner onto the photoreceptor 13 with a development roller and develops an electrostatic latent image which has been formed on the photoreceptor 13 through the exposure. The images of four colors formed on the four photoreceptors 13 in this way are transferred to the carrier 14 in such a way that the four images are superimposed on one another, and thus a color image is formed on the carrier 14. The carrier 14 is a looped belt rotating in the direction indicated by the arrow and is also referred to as an intermediate transfer belt. The secondary transfer rollers 15 transfer the color image onto paper conveyed from a paper tray 17 through the carrier 14. The secondary transfer rollers 15 then convey the paper Lo the fixing device 16 Lo perform fixing on the paper.

The image forming unit 10 ejects the paper after the fixing in the case of one-side image forming, while the image forming unit 10 conveys the paper to the turning-over mechanism 18 in the case of both-side image forming. The turning-over mechanism 18 includes a conveyance path to turn over paper passing by the mechanism 18. The turning-over mechanism 18 leads the turned-over paper to the secondary transfer rollers 15 again.

When image quality is to be adjusted during both-side image forming, the image forming unit 10 forms a patch image, which has been corrected by the image processing unit 9, in the area between the images of the front and back sides formed on the carrier 14, i.e., the intermediate area.

The sensor 19 detects the density of the patch image formed on the carrier 14. The detected value obtained by the sensor 19 is outputted to the control unit 1 as the measurement of the density.

The patch image is not transferred onto paper by the secondary transfer rollers 15 but is removed from the carrier 14 by the cleaning section 20.

Figure 3:
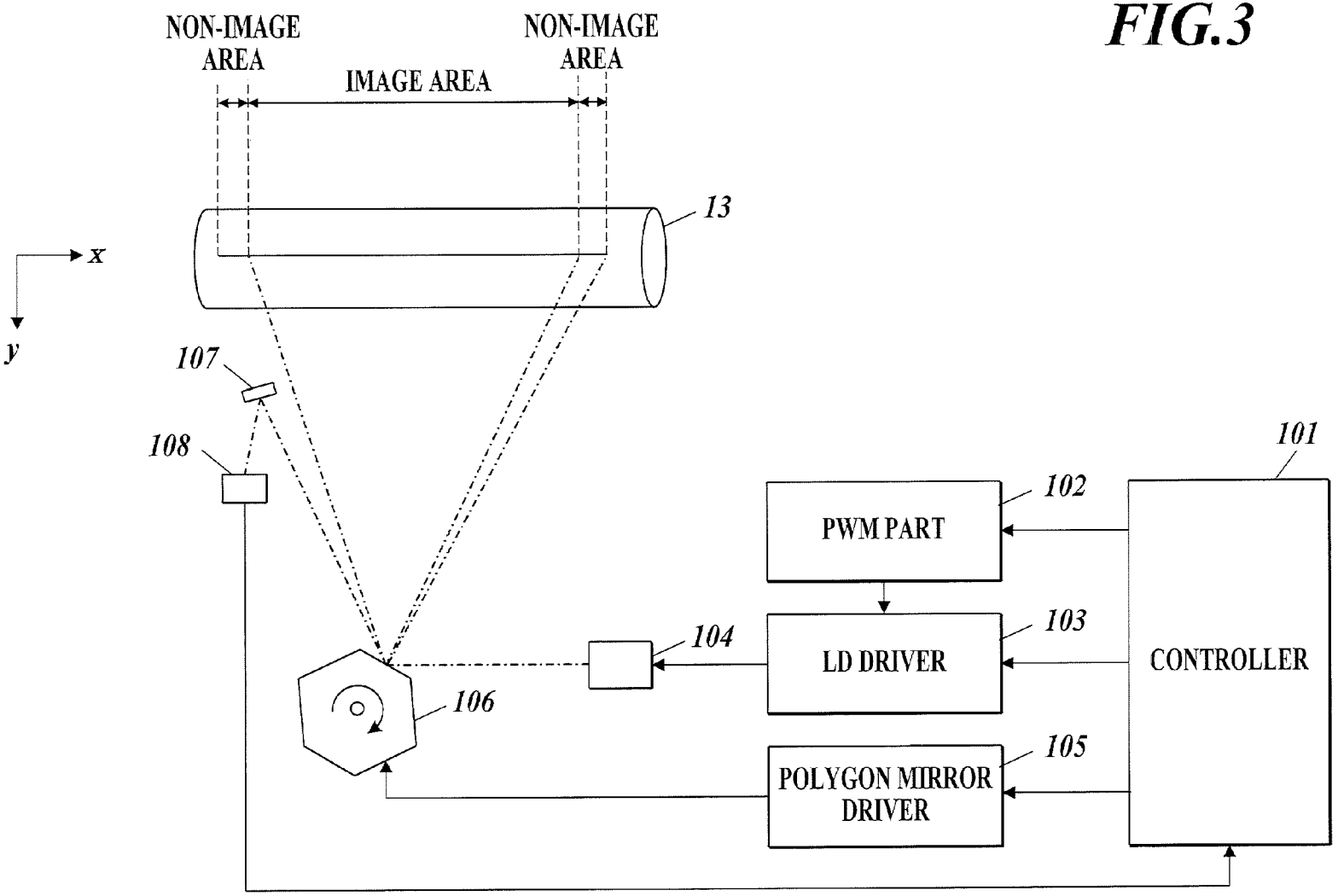
FIG. 3 is a schematic view of an exposure section of FIG. 2.

FIG. 3 is a schematic view of an exposure section 11.

As shown in FIG. 3, the exposure section 11 includes a controller 101, a pulse width modulation (PWM) part 102, a laser diode (LD) driver 103, an LD 104, a polygon mirror driver 105, a polygon mirror 106, a mirror 107, and a sensor 108.

The controller 101 generates synchronization signals in accordance with the detection signal outputted from the sensor 108 in such a way that the starting position of the exposure scanning with respect to the main scanning direction x coincides with that with respect to the sub-scanning direction y to control the exposure timing. The controller 101 generates a pixel clock having a frequency instructed by the control unit 1 and outputs, to the PWM part 102, the pixel clock and the synchronization signals along with the image data.

The controller 101 controls the driving by the LD driver 103 and the polygon mirror driver 105 in synchronization with the synchronization signals. The controller 101 generates a driving signal to rotate the polygon mirror 106 at a predetermined rotation speed in accordance with the speed change condition determined by the control unit 1 and outputs the driving signal to the polygon mirror driver 105.

The PWM part 102 generates a pulse for exposure from image data in accordance with the synchronization signals and the pixel clock. The LD driver 103 drives the LD 104 in accordance with the pulse for exposure outputted from the PWM part 102 to allow the LD 104 to emit light.

The polygon mirror driver 105 drives the polygon mirror 106 in accordance with the driving signal to rotate the polygon mirror 106 at a predetermined rotation speed. The polygon mirror 106 is in the shape of a polyhedron having multiple mirror planes and rotates about the axis.

The beam from the LD 104 is reflected by a mirror plane of the polygon mirror 106 to be delivered to the photoreceptor 13. The rotation of the polygon mirror 106 changes the direction of the beam. The photoreceptor 13 is scanned in the main scanning direction x for exposure. The direction perpendicular to the main scanning direction x on the scanned surface of the photoreceptor 13 is the sub-scanning direction y. The scanning for exposure in the main scanning direction x is repeated each time a mirror plane is switched while the scanning position in the sub-scanning direction y is shifted by the rotation of the photoreceptor 13.

Non-image areas are provided in the both end portions of each line extending in the main scanning direction x, as shown in FIG. 3. The synchronization signals invalidate image formation at the non-image areas.

The sensor 108 detects the beam immediately after a mirror plane of the polygon mirror 106 reflecting the beam switches, and outputs the detection signal to the controller 101. The mirror 107 directs the beam to the sensor 108.

Next, the procedure of the image forming apparatus G is described.

Figure 4:
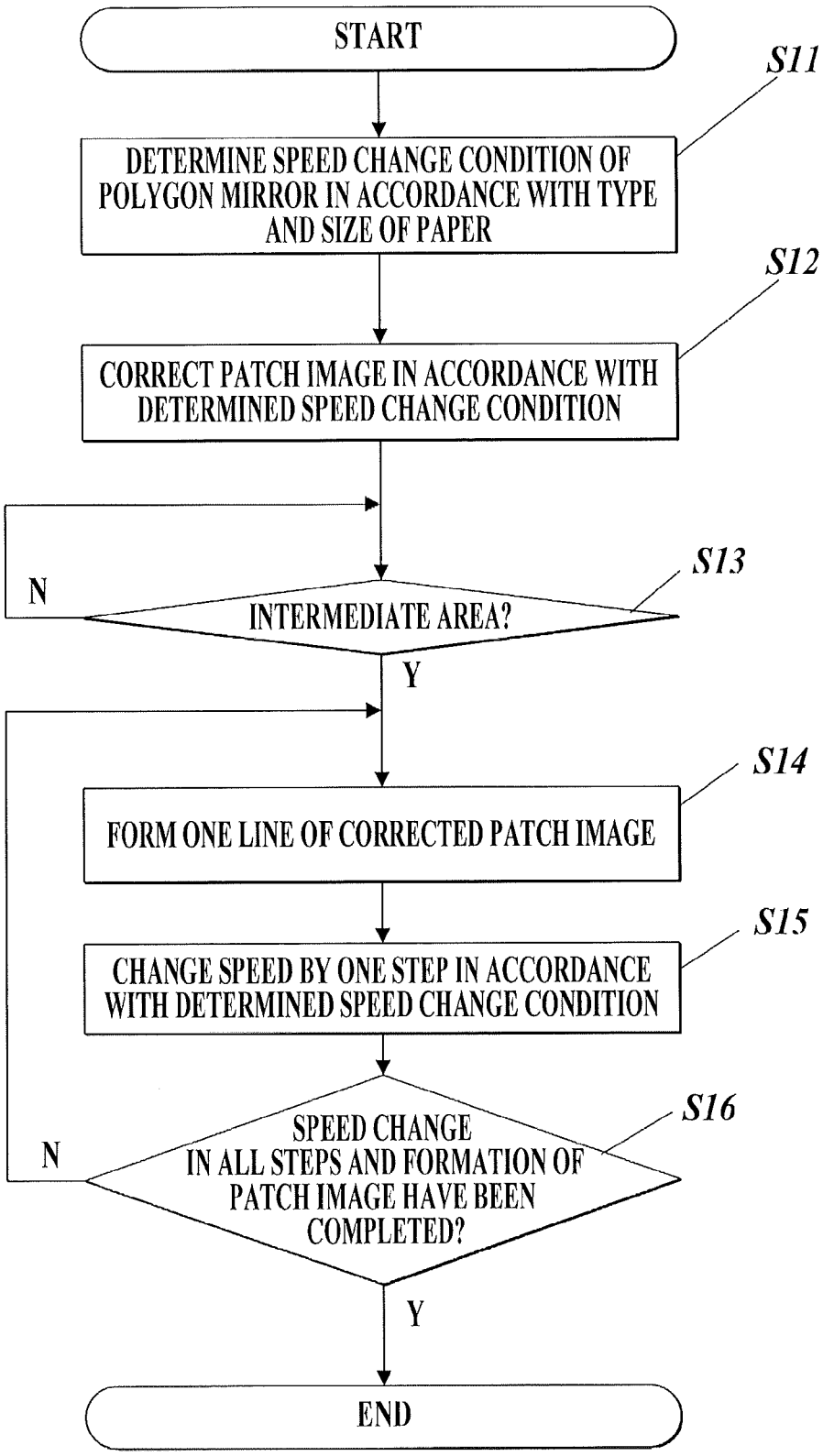
FIG. 4 is a flowchart illustrating intermediate area processing to be executed by the image forming apparatus.

FIG. 4 is a flowchart of intermediate area processing to be executed by the image forming apparatus G in forming a patch image for adjusting image quality during formation of images on both sides of paper.

As shown in FIG. 4, the control unit 1 determines the image reduction/magnification ratio after a change on the basis of the type and size of paper which is being used for the image formation. The control unit 1 further determines a speed change condition for changing the rotation speed of the polygon mirror 106 in a stepwise manner in accordance with the determined image reduction/magnification ratio (Step S11).

The determined speed change condition preferably includes changing of the rotation speed of the polygon mirror 106 by one step at a non-image area provided in each line for forming a corrected patch image. This allows a patch image to be formed in an image area without changing the intervals between pixels of the patch image when the rotation speed is changed, preventing large deformation of the patch image.

The interval between lines for which the one-step speed change is made is not particularly limited: the one-step speed change may be made for every line, or may be made for every few lines.

The description set forth below shows the case in which the control unit 1 determines to change the rotation speed of the polygon mirror 106 by one step at a non-image area in one line each time one line of a corrected patch image is formed.

The control unit 1 determines the speed change for each step to be within a range to allow stable rotations of the polygon mirror 106. The speed change to be made when the image reduction/magnification ratio is changed by ±0.01% for each step is determined to be within a range to allow stable rotations of the polygon mirror 106, the range depending on the characteristics of the polygon mirror 106, though.

The adjustment of the image reduction/magnification ratio between the front and back sides is merely a fine adjustment and the amount of change of the image reduction/magnification ratio is about −1.00 to +1.00% at most. When a speed change is made in such a way as to change the image reduction/magnification ratio by ±0.01% for each line in the main scanning direction, the rotation speed reaches a target speed in 100 lines at the maximum. A short time of an intermediate area, therefore, is enough to complete the speed change.

Figure 5:
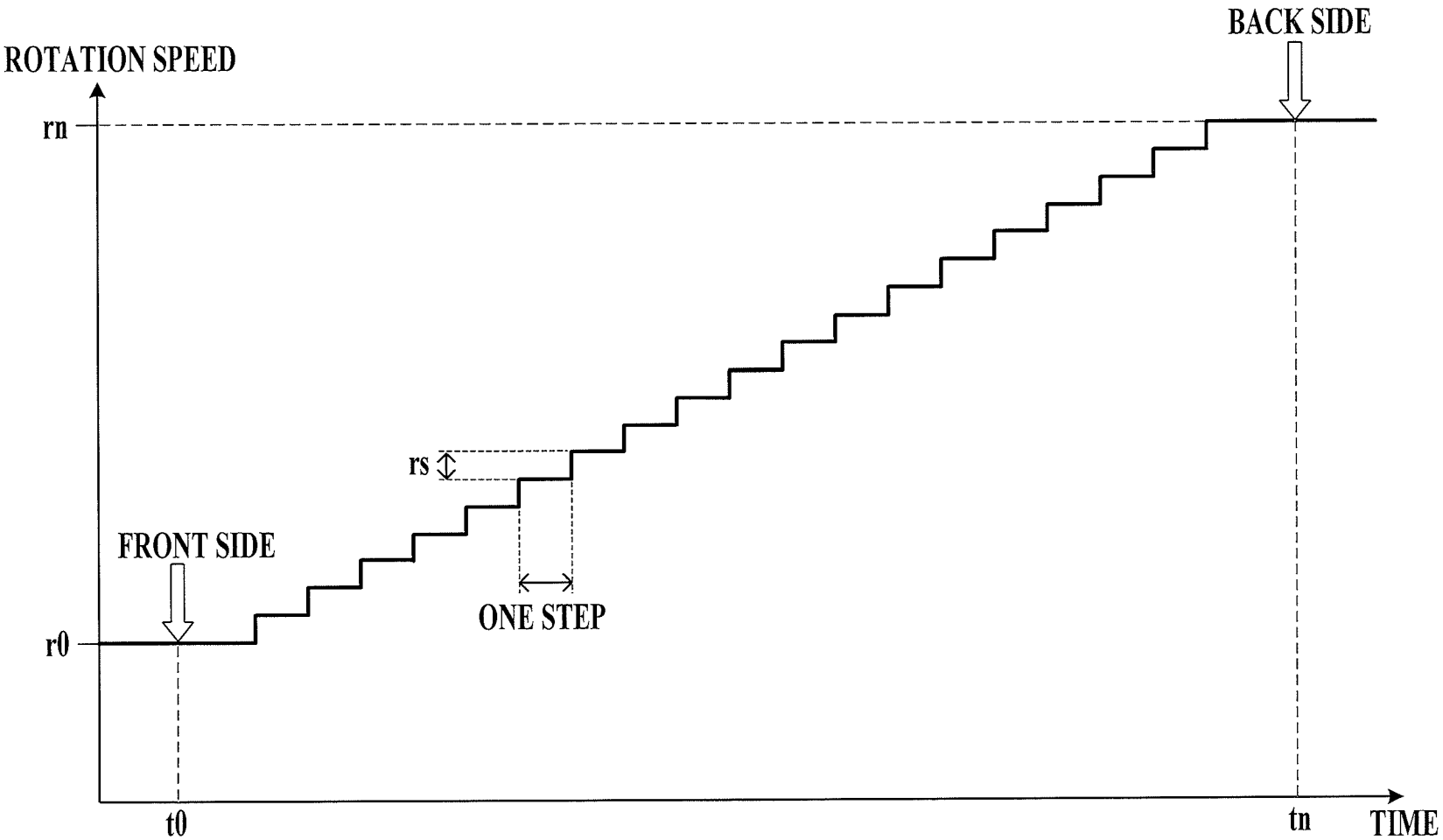
FIG. 5 shows an example of a rotation speed change.

FIG. 5 illustrates a speed change condition when a rotation speed r0 is increased up to a rotation speed rn (r0<rn) in a stepwise manner.

As shown in FIG. 5, the intermediate area (from the end of the image of the front side to the head of the image of the back side) can be used from time t0 to time tn. The control unit 1 determines the total number n of steps in which the rotation speed is increased to a target speed within the time from t0 to tn and determines the rate rs of speed change of one step. The rate rs of speed change is constant in each step and determined Lo be within a range to allow stable rotations of the polygon mirror 106 after the speed change.

The control unit 1 may determine a speed change condition every time. Alternatively, the control unit 1 may obtain a speed change condition stored in the storage unit 2 in the light of the fact that the time for which an intermediate area is available and the degree of shrinkage of paper caused by fixing processing are determined depending on the type and size of the paper. Specifically, the storage unit 2 may store the optimum speed change condition of the polygon mirror 106 for each type and size of paper. The control unit 1 may read the speed change condition corresponding to the type and size of the paper which is being used for the image formation, and the control unit 1 may determine the read condition to be the speed change condition.

The control unit 1 then reads a patch image for image quality correction from the storage unit 2 to output it to the image processing unit 9. The control unit 1 instructs the image processing unit 9 to correct the patch image in accordance with the determined speed change condition.

The image processing unit 9 corrects the patch image for image quality correction in accordance with the speed change condition determined by the control unit 1 and outputs the corrected patch image to the image forming unit 10 (Step S12).

Specifically, the image processing unit 9 corrects the patch image in accordance with the stepwise change of the rotation speed of the polygon mirror 106 in such a way that the position, shape, and density of the patch image are the same as those of the patch image formed when the rotation speed is not changed.

A higher rotation speed of the polygon mirror 106 makes the intervals between pixels smaller, while a lower rotation speed makes the intervals larger than when the rotation speed is not changed. Such decrease/increase of the intervals between pixels causes shifting of the starting and ending positions of the formation of the patch image. This causes a square-shaped patch image to deform into a trapezoid.

Since the rotation speed of the polygon mirror 106 is changed at a non-image area in each line, the intervals between pixels are the same in the same line but are different between different lines (i.e., different along the sub-scanning direction).

The image processing unit 9 adds or deletes a pixel of the patch image in accordance with the stepwise change of the rotation speed or adjusts the starting position of writing of the patch image in such a way that the position and shape of the corrected patch image are the same as those of the patch image formed when the rotation speed is not changed.

Figure 6A:
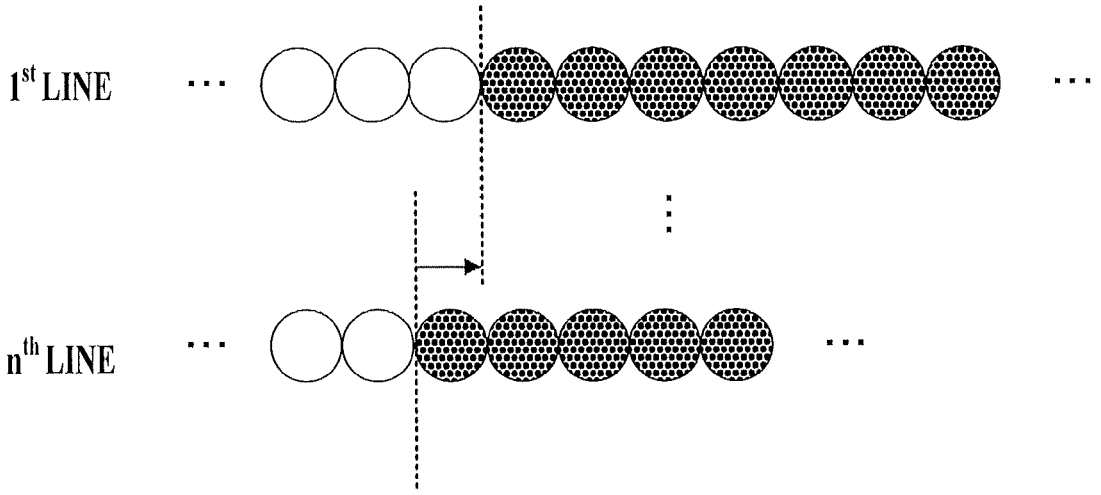
FIG. 6A shows an example of correction of the position and shape of a patch image.

For example, when the rotation speed is made higher, the start point of the $n^{th}$ line of the patch image may be shifted forward of that of the $1^{st}$ line, as shown in FIG. 6A. In FIG. 6A, the circles represent pixels, and the black circles represent pixels of the patch image. In this case, the image processing unit 9 shifts the starting position of writing of the $n^{th}$ line of the patch image backward by one pixel. Alternatively, the image processing unit 9 may delete the pixel at the start point of the $n^{th}$ line of the patch image. This allows the start point of each line of the patch image to coincide with the start point of the $1^{st}$ line.

Figure 6B:
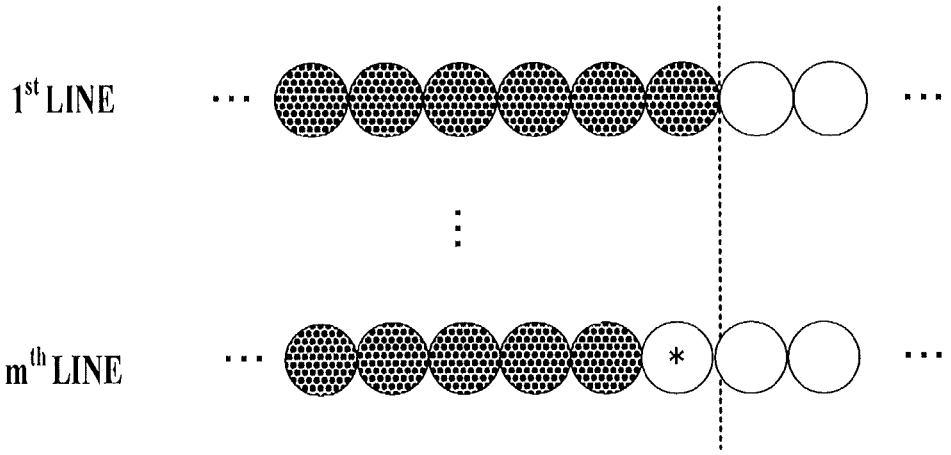
FIG. 6B shows an example of correction of the position and shape of a patch image.

In another case, for example, the end point of the $m^{th}$ line of the patch image may be shifted forward of that of the $1^{st}$ line, as shown in FIG. 6B. In FIG. 6B, the circles represent pixels, and the black circles represent pixels of the patch image. In this case, the image processing unit 9 may add one pixel of the patch image to the position indicated by "*" in the $m^{th}$ line. This allows the end point of each line of the patch image to coincide with the end point of the $1^{st}$ line.

The amount of variation of intervals between pixels of a patch image and the amount of displacement of formed images are different depending on a speed change condition. The image processing unit 9 stores an optimum adjustment value predetermined for each speed change condition, such as the number and positions of pixels to be added or deleted and a starting position of writing of the patch image, in the memory within the image processing unit 9. The image processing unit 9 reads the adjustment value suitable for a speed change condition from the memory and corrects the patch image using the read adjustment value.

The rotation speed change of the polygon mirror 106 changes the time for switching a mirror plane of the polygon mirror 106, leading to a change in interval between lines, i.e., a change in interval between pixels of the patch image along the sub-scanning direction. A small interval between pixels along the sub-scanning direction creates overlaps between beam spots of pixels, leading to partial increase in density. On the other hand, a large interval between pixels along the sub-scanning direction creates spaces between beam spots of pixels, leading to partial decrease in density.

The image processing unit 9 adjusts the gradation value of each pixel of the patch image in accordance with the stepwise change of the rotation speed in such a way that the density of the patch image is the same as that of the patch image formed when the rotation speed is not changed.

When the rotation speed is made higher and the density increases by a predetermined value for each line, for example, the image processing unit 9 decreases the gradation value of the patch image by a predetermined value for each line in accordance with the increase of the density. When the rotation speed is made lower and the density decreases by a predetermined value for each line, for example, the image processing unit 9 increases the gradation value of the patch image by a predetermined value for each line.

As to the amount of variation in density of the patch image, the image processing unit 9 stores the optimum adjustment value for the gradation value predetermined for each speed change condition in the memory within the image processing unit 9. The image processing unit 9 reads an optimum adjustment value to correct a patch image.

When the image formation on the front or back side of paper is completed, the control unit 1 determines that the processing has come to the image formation in the intermediate area (Step S13: Y). The control unit 1 outputs the speed change condition determined in Step S11 to the image forming unit 10 to instruct the image forming unit 10 to change the rotation speed of the polygon mirror 106. The control unit 1 also instructs the image forming unit 10 to form the patch image corrected by the image processing unit 9.

In accordance with the instructions from the control unit 1, the image forming unit 10 forms one line of the corrected patch image in the intermediate area on the carrier 14 (Step S14). When the beam comes to a non-image area from the image area of the line, the image forming unit 10 changes the rotation speed of the polygon mirror 106 by one step in accordance with the instructed speed change condition (Step S15).

The processing of Steps S14 and S15 is repeated until the completion of the speed changes in all the steps and the completion of formation of the corrected patch image (Step S16: N). Specifically, each time the image forming unit 10 forms one line of the patch image, the rotation speed of the polygon mirror 106 is changed by one step in a non-image area of the line.

At the completion of the speed changes in all the steps and the completion of formation of the corrected patch image (Step S16: Y), the processing ends.

Figure 7:
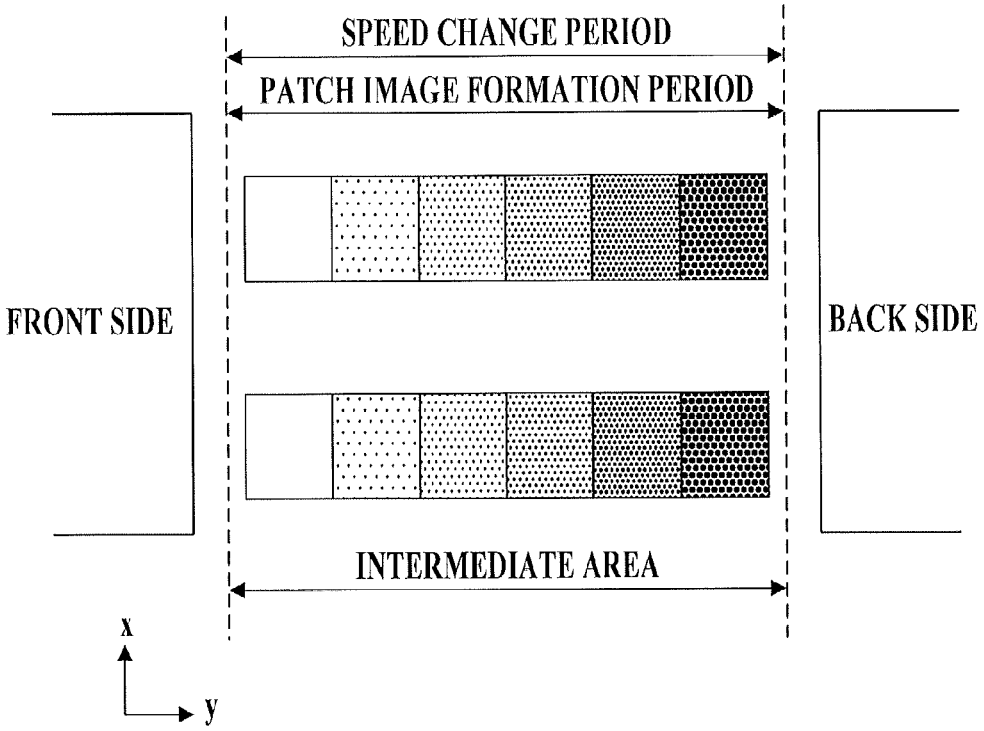
FIG. 7 shows an example of a patch image formed in an intermediate area through the intermediate area processing.

FIG. 7 illustrates a patch image formed in the area between the front and back sides of paper through the intermediate area processing.

The rotation speed of the polygon mirror 106 is changed in a stepwise manner, which requires a longer time than changing the rotation speed at once to a target speed. The speed change at each step, however, is within a range to allow stable rotations and thus a patch image can be formed in parallel with the speed change in each step. Further, since the entire area of the intermediate area can be used for the formation of a patch image, many patches can be formed. Still further, since a patch image to be formed is corrected in accordance with the stepwise change of the rotation speed, the speed change causes less patch image deformation and less variation in density, and the corrected patch image is equivalent to the patch image formed when the rotation speed is not changed.

Figure 8:
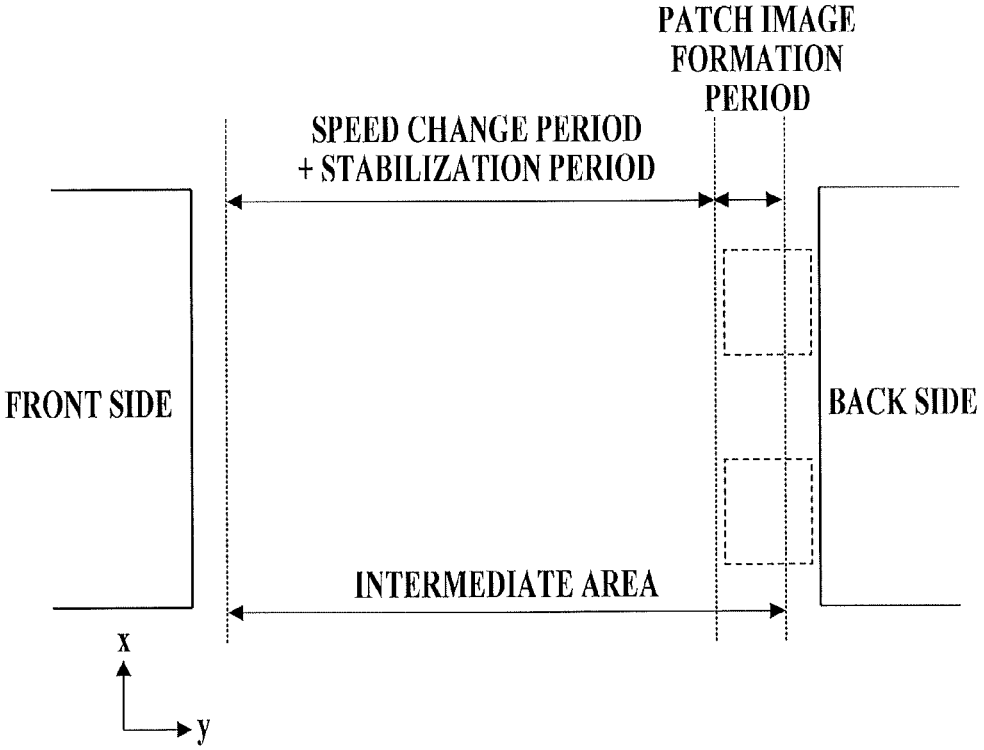
FIG. 8 illustrates an intermediate area in the case in which the rotation speed of a polygon mirror is changed at once to a target speed.

FIG. 8 illustrates an intermediate area in a conventional case in which the rotation speed of the polygon mirror 106 is changed to a target speed at once.

Changing the speed at once causes a large amount of speed change and unstable rotations of the polygon mirror 106 immediately after the speed change and thus requires a period for stabilization after the speed change, as shown in FIG. 8. Shortening of an intermediate area for speed-up and improvement of productivity allows almost no time for forming a patch image in the intermediate area.

When a patch image is formed during the period for speed change and the period for stabilization, the speed change and the unstable rotation speed cause irregular and large deformation of the patch image. Such large deformation may cause the patch image to deviate from the range to be detected by the sensor 19, which may make the density measurement impossible. Further, the density of the patch image tends to vary largely. This hinders proper reproduction of the density of the patch image or causes unevenness in density, making proper adjustment of image quality impossible.

As described above, the image forming apparatus G of this embodiment includes the image forming unit 10 and the control unit 1. The image forming unit 10 exposes the photoreceptor 13 using the polygon mirror 106 and transfers an image obtained by developing an electrostatic latent image formed on the photoreceptor 13 to paper through the carrier 14. The control unit 1 changes the rotation speed of the polygon mirror 106 at the intermediate area on the carrier 14 to change the reduction/magnification ratio of an image to be formed. When the control unit 1 forms a patch image in the intermediate area at which the rotation speed of the polygon mirror 106 is changed, the control unit 1 changes the rotation speed of the polygon mirror 106 in a stepwise manner in such a way that the speed change in each step is within a range to allow stable rotations of the polygon mirror 106. The control unit 1 controls the image forming unit 10 to form a corrected patch image in parallel with the stepwise change of the rotation speed, the corrected patch image being obtained through correction of an original patch image in accordance with the stepwise change of the rotation speed to be the same as the patch image formed when the rotation speed is not changed.

The stepwise change of the rotation speed of the polygon mirror allows stable rotations of the polygon mirror after the speed changes and allows the formation of a patch image in parallel with the speed change in each step. Further, since the entire intermediate area can be used for a patch image, many patches can be formed. The patch image is corrected to be the same as the patch image formed when the rotation speed is not changed, and such a corrected patch image is suitable for adjusting image quality.

In short, a patch image can be formed in parallel with the speed change of the polygon mirror at an intermediate area, the formed patch image being the same as the patch image formed when the rotation speed is not changed.

The embodiments described above are merely preferred examples of the present invention, which is not limited to the embodiments. The embodiments may be modified as appropriate within the scope without departing from the spirit of the present invention.

For example, in the procedure shown in FIG. 4, the image processing unit 9 corrects a patch image. Alternatively, the storage unit 2 may store patch images corrected in advance in accordance with speed change conditions of the polygon mirror 106, and the control unit 1 may read a corrected patch image to control the image forming unit 10 to perform image formation.

Specifically, the storage unit 2 stores a table in which the amount of change of image reduction/magnification ratio and the patch image are determined for each type and size of paper, as shown in FIG. 9. Each patch image has been corrected in accordance with the speed change condition which varies depending on the type and size of paper.

In this case, the procedure is different from the intermediate area processing shown in FIG. 4 only in that Step S12 reads a corrected patch image instead of correcting a patch image. Otherwise, this modification is the same as the intermediate area processing shown in FIG. 4.

Specifically, the control unit 1 reads, from the storage unit 2, a corrected patch image corresponding to the type and size of the paper and outputs the read corrected patch image to the image processing unit 9. Taking FIG. 9 as an example, when the paper which is being used for image formation is A4-size high-quality paper, the control unit 1 reads the patch image g11 for the intermediate area, from the front side to the back side; and reads the patch image g12 for the intermediate area, from the back side to the front side. The image processing unit 9 performs screen processing on the inputted patch image g11 or g12 and outputs the resultant to the image forming unit 10. The image forming unit 10 forms the corrected patch image in the image area of the intermediate area as described above.

The type and size of the paper to be used by the image forming apparatus G are often steady. The image forming apparatus G thus may read a patch image which has already been corrected instead of performing image processing to correct a patch image each time image quality adjustment is performed. This leads to efficient formation of a patch image.

The image forming apparatus G keeps paper in such a way that the type and size of paper are associated with each paper tray 17. The storage unit 2 may store the paper trays 17 and corrected patch images in such a way that each paper tray 17 is associated with the corresponding corrected patch image, as shown in FIG. 9. The control unit 1 may read the corrected patch image corresponding to the paper tray 17 selected at the time of setting for image formation.

As a computer readable medium having stored thereon the program to allow the image forming apparatus G to execute the above-described intermediate area processing, a non-volatile memory such as a read-only memory (ROM) and a flash memory or a portable storage medium such as a compact disc read only memory (CD-ROM) may be used. Additionally a carrier wave may also be applied as a medium to provide the data of the program via a communication line.

The entire disclosure of Japanese Patent Application No. 2013-016292 filed on Jan. 31, 2013 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An image forming apparatus comprising:

an image forming unit which exposes a photoreceptor using a polygon mirror and transfers an image obtained by developing an electrostatic latent image formed on the photoreceptor to paper through a carrier; and a control unit which changes a rotation speed of the polygon mirror at an intermediate area on the carrier to change a reduction/magnification ratio of an image to be formed, wherein when a patch image is formed in the intermediate area, the control unit changes the rotation speed of the polygon mirror in a stepwise manner in such a way that the change of the rotation speed in each step is within a range to allow a stable rotation of the polygon mirror; and controls the image forming unit to form a corrected patch image in parallel with the stepwise change of the rotation speed, the corrected patch image being obtained through correction of an original patch image in accordance with the stepwise change of the rotation speed to be the same as a patch image formed when the rotation speed is not changed.

2. The image forming apparatus according to claim 1, wherein the control unit changes the rotation speed of the polygon mirror by one step at a non-image area in each line for forming the corrected patch image.

3. The image forming apparatus according to claim 1, wherein the corrected patch image is obtained by adding or deleting a pixel to or from the original patch image or by adjusting a starting position of writing of the original patch image in such a way that a position and shape of the corrected patch image are the same as a position and shape of the patch image formed when the rotation speed is not changed.

4. The image forming apparatus according to claim 1, wherein the corrected patch image is obtained by adjusting a gradation value of each pixel of the original patch image in such a way that a density of the corrected patch image is the same as a density of the patch image formed when the rotation speed is not changed.

5. The image forming apparatus according to claim 1, wherein the control unit determines a speed change condition for the stepwise change of the rotation speed in accordance with a type and size of the paper; and controls the image forming unit to form the corrected patch image obtained through the correction in accordance with the determined speed change condition.

6. The image forming apparatus according to claim 5, further comprising an image processing unit which corrects the original patch image in accordance with the determined speed change condition, wherein the control unit controls the image forming unit to form the corrected patch image obtained through the correction by the image processing unit.

7. The image forming apparatus according to claim 5, further comprising a storage unit which stores a plurality of corrected patch images obtained through correction of the original patch image in accordance with different speed change conditions, wherein the control unit reads, from the storage unit, the corrected patch image obtained through the correction in accordance with the determined speed change condition; and controls the image forming unit to form the read corrected patch image.

* * * * *